US006727433B2

(12) United States Patent
Tsai

(10) Patent No.: US 6,727,433 B2
(45) Date of Patent: Apr. 27, 2004

(54) COLOR CABLE AND THE MANUFACTURING METHOD THEREFOR

(76) Inventor: Cheng-Lang Tsai, No. 38, Lane 196, Kwangfu Rd., Sec. 2, San Chung City, Taipei Hsien (TW)

( * ) Notice: Subject to any disclaimer, the term of this patent is extended or adjusted under 35 U.S.C. 154(b) by 228 days.

(21) Appl. No.: 10/023,986

(22) Filed: Dec. 21, 2001

(65) Prior Publication Data

US 2002/0088639 A1 Jul. 11, 2002

Related U.S. Application Data

(63) Continuation-in-part of application No. 09/573,173, filed on May 19, 2000, now abandoned.

(51) Int. Cl.[7] ..... H01B 7/00
(52) U.S. Cl. ..... 174/110 R; 174/112; 174/113 R
(58) Field of Search ..... 174/110 R, 110 AR, 174/110 FC, 111, 113 R, 113 C, 116, 120 R, 112, 36; 29/728, 745; 242/166, 43 R, DIG. 2

(56) References Cited

U.S. PATENT DOCUMENTS 1,968,903 A * 8/1934 Norton ..... 156/55
2,831,277 A * 4/1958 Strachan ..... 206/447
3,997,122 A * 12/1976 Helfand et al. ..... 242/160.2
4,523,086 A * 6/1985 Eilentropp ..... 219/549
4,578,136 A * 3/1986 Brown ..... 156/249
5,281,764 A * 1/1994 King et al. ..... 174/112
5,350,885 A * 9/1994 Falciglia et al. ..... 156/50
5,466,011 A * 11/1995 Cohn ..... 283/67
5,745,628 A * 4/1998 Benzel et al. ..... 385/104
5,862,774 A * 1/1999 Moss ..... 116/200
5,917,151 A * 6/1999 O'Brien et al. ..... 174/72 A
5,922,996 A * 7/1999 Ryeczek ..... 116/207
5,995,702 A * 11/1999 Tjonneland ..... 362/554

FOREIGN PATENT DOCUMENTS

GB WO 94/11886 A * 5/1994 ..... H01B/7/00

* cited by examiner

*Primary Examiner*—William H. Mayo, III
(74) *Attorney, Agent, or Firm*—Bacon & Thomas, PLLC

(57) ABSTRACT

A color cable and the manufacturing method thereof involves an electrical transmission cable having one or more conductors, one or more color windings uniformly wound around and secured to conductor body by heating, and a transparent plastic covering formed on the winding by injection molding. The color of the winding may be seen from outside through the transparent plastic covering. A multi-colored cable is obtained by changing the color or number of the strands, or by substituting strands or windings of one color for strands or windings of another color during winding.

12 Claims, 5 Drawing Sheets

COLOR CABLE AND THE MANUFACTURING METHOD THEREFOR

This application is a continuation-in-part of copending U.S. patent application Ser. No. 09/573,173, filed May 19, 2000, and now abandoned.

FIELD OF THE INVENTION

The present invention relates to the art of cable and more particularly to a color cable and the manufacturing method therefor.

BACKGROUND OF THE INVENTION

Conventionally, manufacture of an electrical signal or current transmitting cable comprises the step of surrounding a strand of conductor by an insulated cylinder of opaque plastic material using extrusion molding techniques. Color versions of such a cable are obtained by adding a color additive to the plastic material. However, this design suffers from the disadvantage that the color of cable, whether monotonous or irregular, is determined solely by the additive to the plastic material of the outer insulated cylinder, and as a result it is not possible to provide a multi-colored cable, or a color cable in which the color or colors of individual strands or cables within the insulation may be viewed.

Another conventional transmission cable manufacturing technique is to surround a strand of conductor by a transparent plastic material in the form of a cylinder by extrusion molding. However, in the conventional design, color is still obtained by adding a color additive to the plastic material and, therefore, despite its transparency, the color of the cable is still determined solely by the additive to the material of the outer insulator. As a result, it is impossible to obtain a multi-colored cable through such a cable manufacturing technique.

One way to solve this problem is to provide a color cable and a manufacturing method therefor in which the cable comprises a conductor body having one or more conductors, one or more color windings uniformly wound around and secured to the conductor body by heating, and a transparent plastic covering formed on the winding by extrusion molding, as described in copending parent U.S. patent application Ser. No. 09/573,173. Using this method, a multi-colored cable can be obtained simply by changing the color or number of strands, and/or by changing windings during the winding process. The results may be purely decorative purpose or the color of the cable may be varied according to electrical specifications and usage, so that the user can recognize the same from the color of the cable.

However, despite the advantages of this method, several problems can still arise if the technique is not properly implemented:

First, if the thickness of the color windings is over 0.035 mm, the color cable will become inflexible, and the outer diameter of the cable will be difficult to maintain in a size small enough required specifications. In addition, the resulting cable will lack uniformity dues to thickness differences in the overlap region.

Second, if the thickness of the color windings is below 0.015 mm, the color windings will be too easily broken by the tension applied as the strip is wound onto the cable.

Third, if the width of the color windings is out of the range of 1–3 mm, the windings will be difficult to wind at a very high speed, and will be subject to folding, resulting in wrinkles that cause the cable to have a poor reflective color and a rough surface.

Fourth, if the overlapped region of the strip is over 50% if the width, the color cable will also have a rough surface, the outer diameter of the cable will be increased, and the material in the windings will in general be substantially wasted. On the other hand, if the overlapped region is below 20% of the width, the cable on which the windings are wound may become exposed upon bending, either resulting in a permanent gap or wrinkles.

SUMMARY OF THE INVENTION

It is accordingly a first objective of the invention to provide a color cable and a manufacturing method therefor in which the cable comprises a conductor body having one or more conductors, one or more color windings uniformly wound around and secured to the conductor body by heating, and a transparent plastic covering formed on the winding by extrusion molding, and which does not suffer from undue stiffness or size, wrinkling, of lack of uniformity, and yet that can easily be manufactured at high speed.

It is another object of the present invention to provide a color cable and the manufacturing method therefor wherein the color of the winding wound around the conductor body can be seen through the surrounded transparent plastic material, resulting in a colorful cable, and yet that is durable, flexible, uniform, and easily manufactured.

It is still another object of the present invention to provide a color cable and the manufacturing method therefor wherein the color of the cable can be varied according to electrical specifications and usage, so that a user can recognize the same from the color of cable, and yet that is durable, flexible, uniform, and easily manufactured.

These objectives are achieved, in accordance with the principles of a preferred embodiment of the invention, by providing a color cable and a manufacturing method therefor in which the cable comprises a conductor body having one or more conductors, one or more color windings uniformly wound around and secured to the conductor body by heating, and a transparent plastic covering formed on the winding by extrusion molding, and in which the conductor body includes at least one electrical signal or power transmission cable having at least one conductor, the winding has a thickness of between approximately 0.015 and 0.035 mm, a width of between approximately 1 and 3 mm, and is overlapped during winding to form an overlapped region of between approximately 20% and 50% of the width of the winding, and the transparent plastic covering is made of PET, PP, PVC, or PE.

The above and other objects, features and advantages of the present invention will become apparent from the following detailed description taken with the accompanying drawings.

DETAILED DESCRIPTION OF THE PREFERRED EMBODIMENTS

Figure 2:
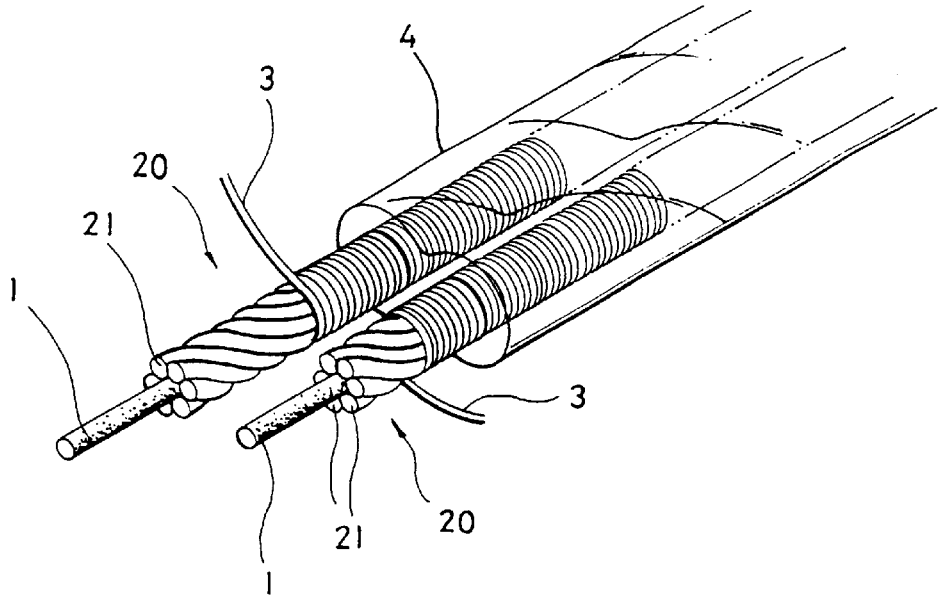
FIG. 2 is a perspective view schematically showing a second preferred embodiment of a color cable according to the invention where a central positioning wire is provided.
Figure 1:
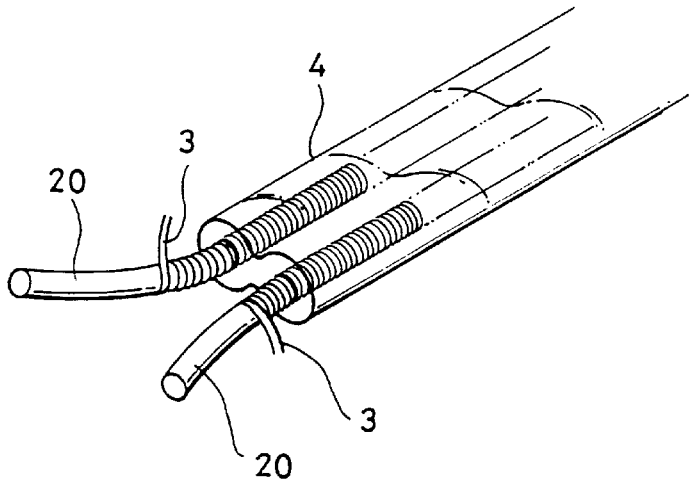
FIG. 1 is a perspective view schematically showing a first preferred embodiment of a color cable according to the invention.

Referring to FIGS. 1 and 2, there is shown a color electrical signal or power transmission cable constructed in accordance with the invention comprising a conductor body in the form of a cable 20 having one or more conductors (e.g., six strands shown on FIG. 2) 21, one or more color winding 3 (including one with a rectangular cross section) uniformly wound around and secured to conductors 21 by heating, and a covering 4 of transparent plastic material formed on the color winding 3 by extrusion molding. As a result, the color of winding 3 may be seen from outside through the transparent plastic covering 4.

The color winding is preferably in the form of a strip having a thickness of between approximately 0.015 and 0.035 mm and a width of between approximately 1 and 3 mm, and is preferably overlapped during winding to form an overlapped region of between approximately 20% and 50% the width of the strip. In addition, the transparent plastic covering is made of PET, PP, PVC, or PE.

Referring to FIG. 1 specifically, the number of cable 20 may be varied depending on the application (e.g., two cables 20 are shown). Importantly, they are spaced from each other if two or more sets of cables 20 are provided in order to maintain insulation therebetween. Also, the number of conductors 21 may be varied for different applications, although the number of conductors 21 should be at least one.

Referring to FIG. 2 specifically, a central positioning wire 1 is provided with six conductors 21 wound around to form an electrical transmission cable 20. Color winding 3 may be formed of a single color, or alternatively may be formed of two or more windings 3 with different colors stranded as one. As a result, a colorful cable is obtained by changing the color of winding 3 of the number of strands thereof, or by substituting a winding of one color for a winding of another color during winding. The color of winding 3 is seen from the outside through the transparent plastic covering 4.

Figure 3:
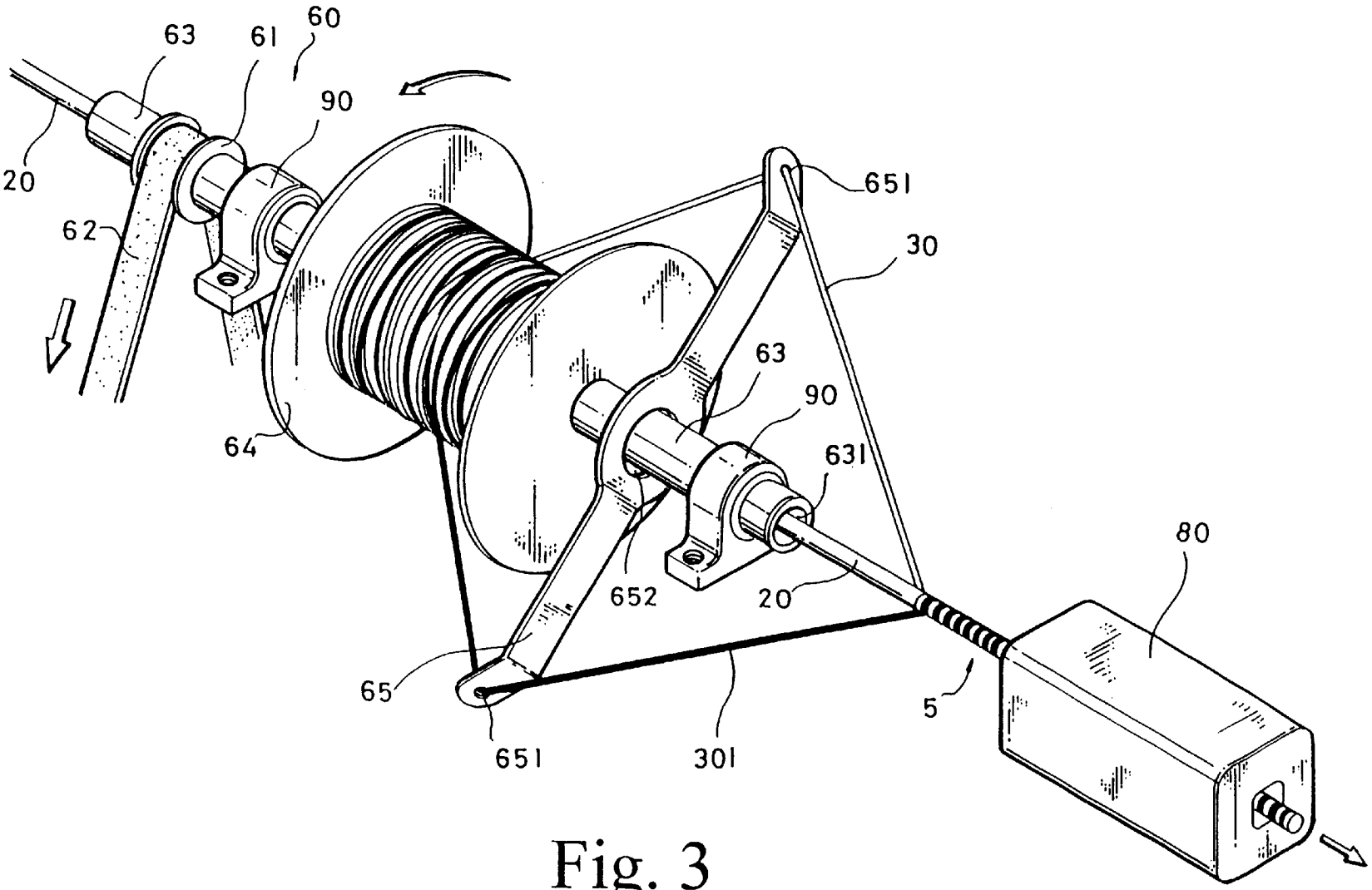
FIG. 3 is a perspective view showing the manufacturing process for a color cable according to the invention, where the cable is not formed together with the transparent plastic material.

Referring to FIG. 3, the manufacturing process of a color cable according to the invention involves the following steps: First, cable 20 is threaded through the bore 631 of a shaft 63 of winding device 60, and then is axially moved through the bore 631 at a predetermined speed. Shaft 63 is supported by at least one bearing means 90 (two are shown). A pulley 61 is connected to the shaft 63. A belt 62, at a distal end of shaft 63, driven by a drive source (not shown) extends around the shaft 63 so that shaft 63 can be rotated. A spool 64 and a flywheel 65 are located between the bearing means 90. One or more color windings 3 are wound around spool 64, which is fixed on shaft 63, and flywheel 65 is rotatable on shaft 63 by having shaft 63 pass through the hole 652. As shown, one line of winding 3 is passed through one eye 651, while the other line of winding 3 is passed through the other eye 651 prior to being wound around cable 20 to form a color cable 5. Flywheel 65 is rotated at a speed slower than the spool 64 due to the friction with the shaft 63. As such, the stability of color winding 3 may be maintained during rotation, resulting in uniform winding of color winding 3 on cable 20, provided that the strands of the winding have a thickness of between approximately 0.015 and 0.035 mm and a width of between approximately 1 and 3 mm, and that they are overlapped during winding to form an overlapped region of between approximately 20% and 50% the width of the strands, as described above. Preferably, winding 3 is coated with an adhesive in a preparatory manufacturing process in order to increase the adhesion between the winding and cable 20 during the winding process. This assures the uniformity of wound winding 3. A heating device 80 is provided at the proximal end for heating the passed color cable 5. This further secures the winding 3 on conductor body 20.

Figure 4:
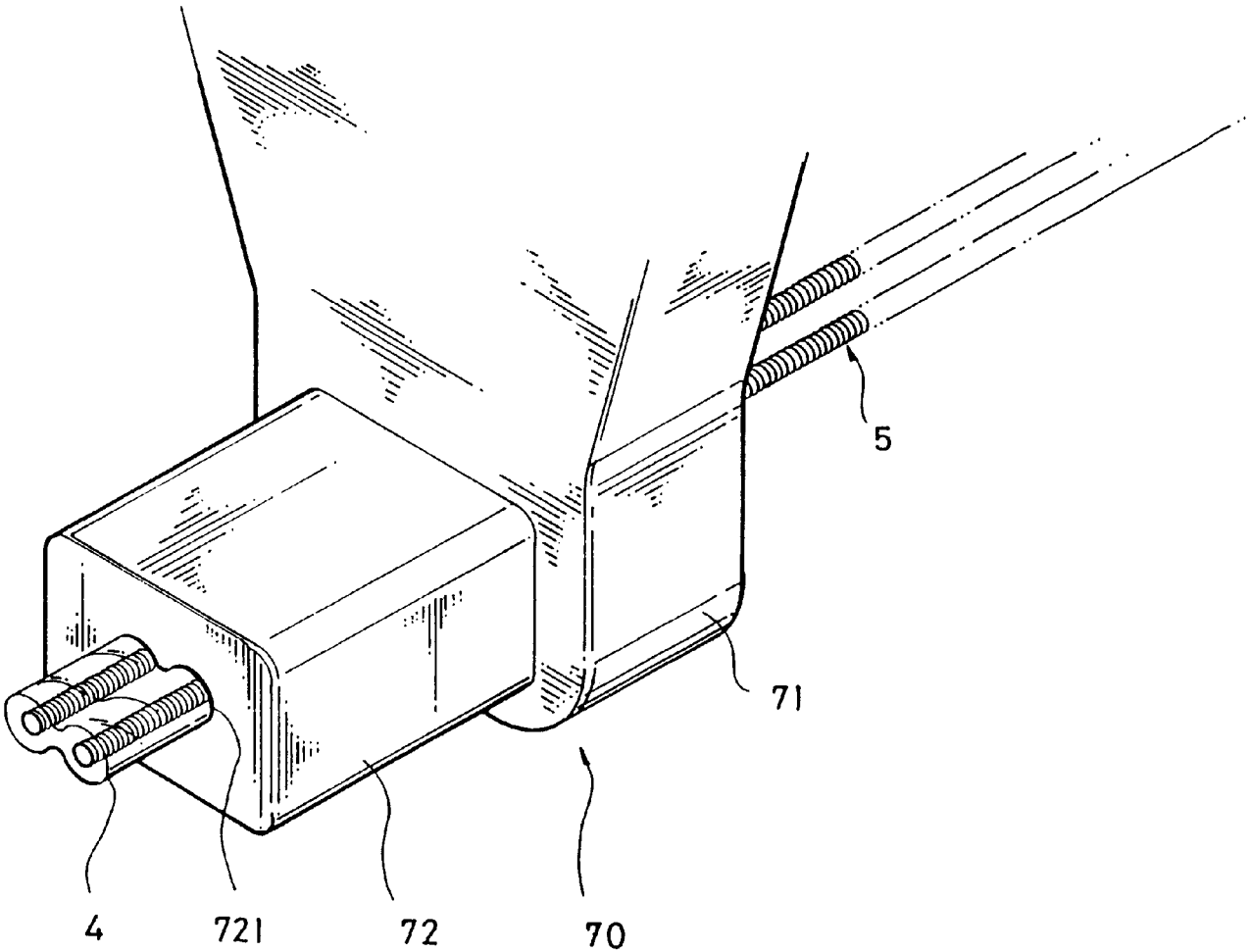
FIG. 4 is a perspective view showing the manufacturing process for a color cable according to the invention, where the cable is formed together with the transparent plastic material.

Referring to FIG. 4, one or more color cables 5 (two are shown) are guided through an extrusion molding device 70 for surrounding the color cable 5 with a transparent plastic material. Extrusion molding device 70 has a mold 72 with a hole 721 that extends through extrusion molding device 70 and mold 72. A color cable 5 with a transparent plastic covering 4 is formed after going through the extrusion molding device 70. The two color cables 5 are spaced from each other in order to maintain insulation therebetween as well as to transmit signals and/or allow current to pass. As a result, the cable of winding 3 can be seen through the surrounded transparent plastic covering 4.

A number of techniques are capable of changing the color of cable as detailed below.

Figure 5:
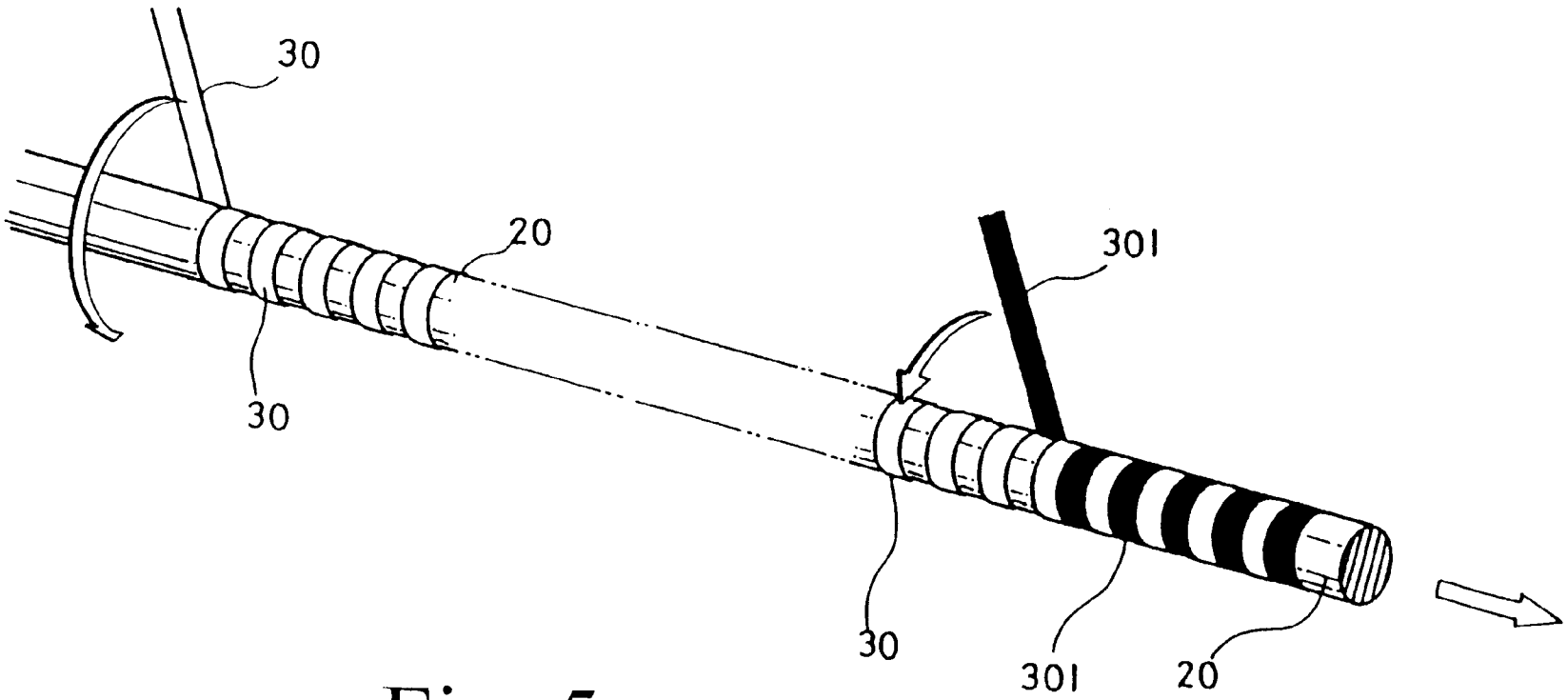
FIG. 5 is a perspective view showing a manufacturing process for a color cable according to the invention, where two windings with different colors are wound around the conductor body sequentially.

Referring to FIG. 5, two windings 30 and 301 with different colors driven by respective winding devices 60 at different speeds may be wound around cable 20 sequentially.

Figure 6:
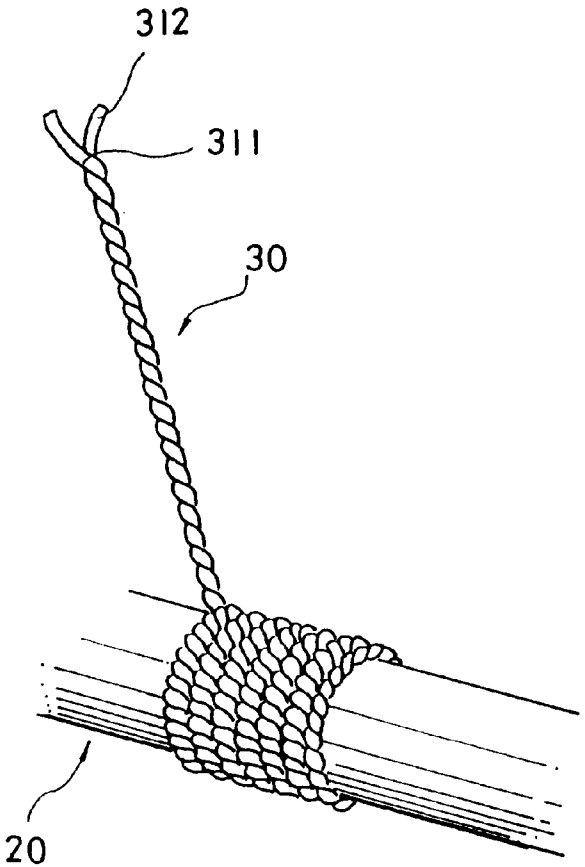
FIG. 6 is a perspective view showing another manufacturing process for a color cable according to the invention, where two windings with different colors are stranded as one prior to being wound around the conductor body.

Alternatively, referring to FIG. 6, two windings 311 and 312 with different colors may be stranded as one winding 30 prior to being wound around cable 20.

The benefits of this invention include:

1. Provision of a more decorative cable, and/or
2. The ability to vary the color of the cable for different electrical specifications and usage, so that the user can recognize the specifications and usage based on the color of cable.

While the invention herein disclosed has been described by means of specific embodiments, numerous modifications and variations could be made thereto by those skilled in the art without departing from the scope and spirit of the invention set forth in the claims.

What is claimed is:

1. A color cable comprising:

at least one electrical transmission cable having at least one conductor;

at least one color winding uniformly wound around and secured to said cable, said at least one color winding including a strip having a thickness of between approximately 0.015 and 0.035 mm and a width of between approximately 1 and 3 mm, wherein edges of said strip are overlapped to form an overlapped region of between approximately 20% and 50% the width of the strip; and an extrusion molded transparent plastic covering formed on said at least one color winding.

2. A color cable as claimed in claim 1, further comprising a second said electrical transmission cable having at least one conductor, said second said electrical transmission cable being spaced from said at least one transmission cable, wherein a respective said at least one color winding is wound around each of said electrical transmission cables and said electrical transmission cables are commonly covered by said transparent plastic covering.

3. The color cable of claim 1, wherein said transparent plastic covering is made of a material selected from the group consisting of PET, PP, PVC, and PE.

4. The color cable of claim 1, further comprising a central positioning wire with said conductor wound around.

5. The color cable of claim 1, wherein said color winding is formed of a plurality of windings with different colors stranded as one.

6. A color cable manufacturing method comprising the steps of:

(a) uniformly winding at least one color winding around at least one electrical transmission cable by at least one winding device to form a color cable; and (b) guiding said at least one electrical transmission cable through an extrusion molding device to surround said color cable with a transparent plastic material, wherein each said at least one electrical transmission cable in said color cable is spaced from all other electrical transmission cables in said color cable, and wherein said step of winding comprises the step of forming an overlapped region of between approximately 20% and 50% the width of the strip.

7. The method of claim 6, further comprising a heating device for heating said color winding wound around said transmission cable, thereby securing said color winding on said transmission cable.

8. The method of claim 6, wherein said winding is coated with an adhesive in a preparatory process for increasing adhesion between the winding and the transmission cable.

9. The method of claim 6, wherein said color winding is formed of a plurality of windings with different colors stranded as one winding prior to being wound around said transmission cable.

10. The method of claim 6, wherein a plurality of color windings with different colors driven by respective associated winding devices are wound around said transmission cable sequentially.

11. The method of claim 6, wherein said color winding is formed of a plurality of threads with different colors.

12. The method of claim 6, wherein said transmission cable is formed of a plurality of conductors.

* * * * *